US007143559B1

(12) United States Patent
Ritter

(10) Patent No.: US 7,143,559 B1
(45) Date of Patent: Dec. 5, 2006

(54) METHOD AND DEVICE FOR PRODUCTION OF A PRE-FABRICATED CAST CONCRETE ELEMENT

(75) Inventor: Klaus Ritter, Graz (AT)

(73) Assignee: EVG Entwicklungs- u. Verwertungs-Gesellschaft m.b.H., Raaba (AT)

( * ) Notice: Subject to any disclaimer, the term of this patent is extended or adjusted under 35 U.S.C. 154(b) by 179 days.

(21) Appl. No.: 10/148,280

(22) PCT Filed: Nov. 17, 2000

(86) PCT No.: PCT/AT00/00309

§ 371 (c)(1),
(2), (4) Date: Oct. 8, 2002

(87) PCT Pub. No.: WO01/38664

PCT Pub. Date: May 31, 2001

(30) Foreign Application Priority Data

Nov. 26, 1999 (AT) ..... 2007/99

(51) Int. Cl.
*E04C 2/22* (2006.01)

(52) U.S. Cl. ..... 52/309.7; 52/309.12; 52/405; 52/410; 52/309.11

(58) Field of Classification Search ..... 52/309.11, 52/309.12, 425, 426, 431, 794.1, 793.1, 427, 52/428, 442, 563, 569, 679, 680, 410, 577, 52/600, 576, 382, 582, 405, 745.04, 745.05; 249/214, 216, 213, 40, 41, 190, 84, 90, 91, 249/94, 96, 97; 264/31, 35
See application file for complete search history.

(56) References Cited

U.S. PATENT DOCUMENTS 3,785,610 A * 1/1974 Dagiel ..... 249/214
3,879,908 A * 4/1975 Weismann ..... 52/309.5
4,104,842 A * 8/1978 Rockstead et al. ..... 52/649.1
4,297,820 A * 11/1981 Artzer ..... 52/309.11
4,505,019 A * 3/1985 Deinzer ..... 29/432
4,541,164 A * 9/1985 Monzon Indave ..... 29/430
4,702,053 A * 10/1987 Hibbard ..... 52/309.7
4,888,931 A * 12/1989 Meilleur ..... 52/426
5,129,203 A * 7/1992 Romero ..... 52/309.11
5,431,368 A 7/1995 Wilde ..... 249/213
5,596,853 A * 1/1997 Blaney et al. ..... 52/223.7
6,138,981 A * 10/2000 Keith et al. ..... 249/41
6,378,261 B1 * 4/2002 Agsten ..... 52/426

FOREIGN PATENT DOCUMENTS

AT OE 316 091 5/1974
WO WO 94/28264 12/1994

* cited by examiner

*Primary Examiner*—Daniel P. Stodola
*Assistant Examiner*—Nahid Amiri
(74) *Attorney, Agent, or Firm*—Cohen, Pontani, Lieberman & Pavane

(57) ABSTRACT

Device for producing a prefabricated cast concrete element having a plurality of central structural elements each comprising two parralel welded wire lattice mats, straight bridging wires welded at each end to the two wire lattice mats holding the wire lattice mats at a predetermined mutual separation and an insulating member penetrated by the bridging wires arranged with its cover surfaces parallel to the wire lattice mats and at a predetermined distance to the latter and having two concrete shells which each adjoin the insulating member and completely enclose the wire lattice mats of the structural elements, characterized in that a plurality of central structural elements are each arranged with their narrow sides abutting one another with selectable spacing between two shuttering walls and the spaces between the insulating members of the structural elements and the shuttering walls completely filled out with concrete.

3 Claims, 7 Drawing Sheets

METHOD AND DEVICE FOR PRODUCTION OF A PRE-FABRICATED CAST CONCRETE ELEMENT

This application is a U.S. National Phase Application under 35 U.S.C. 371 of International Application PCT/AT00/00309 (not published in English) filed Nov. 17, 2000.

BACKGROUND OF THE INVENTION

1. Field of the Invention

The invention relates to a method and a device for producing a prefabricated cast concrete element having a plurality of central structural elements each comprising two parallel welded wire lattice mats, straight bridging wires welded at each end to the two wire lattice mats holding the wire lattice mats at a predetermined mutual separation and an insulating member penetrated by the bridging wires arranged with its cover surfaces parallel to the wire lattice mats and at a predetermined distance from the latter and having two concrete shells which each adjoin the insulating member and completely enclose the wire lattice mats of the structural elements.

2. Description of the Prior Art

WO 94/28264 discloses a structural element of this generic category whose two concrete shells are sprayed in layers onto the cover surfaces of the insulating member by the wet or dry method preferably at the point of use of the prefabricated wall. In the case of very thick concrete shells pouring of the shells using site-mixed concrete is also possible. In doing this it is disadvantageous that the layered application of the concrete shell is very time-consuming and, moreover, the bonding of the individual layers is not always ensured.

SUMMARY OF THE INVENTION

It is an object of the invention to avoid the disadvantages described and to provide a method and a device for producing a prefabricated element which allow in simple manner the production of a prefabricated element of the type specified at the outset and the adaptation of the dimensions of the prefabricated element to differing static requirements.

The method according to the invention is characterised in that a plurality of central structural elements each with their narrow sides abutting one another are arranged at a variable distance between two shuttering walls and the spaces between the insulating members of the structural elements and in that the shuttering walls, as known per se, are completely filled out with concrete.

It should be mentioned that it is known from the U.S. Pat. No. 4,702,053 in connection with a method of another kind to fill the spaces between the insulating member of the structural elements and the shuttering walls.

The concrete shells are preferably cast in several working operations, wherein consecutive work operations are performed before the concrete is completely hardened.

Preferably, the method is employed according to the invention for producing vertical prefabricated walls. In doing so, to form a vertical prefabricated wall a plurality of structural elements is arranged according to the invention each in abutment beside one another in the vertical and horizontal direction and the lower structural elements are each anchored in fixed position in a base plate, wherein structural elements adjoining in the horizontal direction are arranged in alignment in a straight line and/or along a curved line and/or also at any desired angle relative to one another.

A device destined for carrying out the described method is characterised according to the invention in that for producing the spacings between the structural elements and the shuttering walls a plurality of spacing members composed of rustproof materials is provided between the shuttering walls and the wire lattices and in that the shuttering walls, as known per se, are composed of a plurality of sections connectable to one another.

According to a preferred embodiment of the device distance pieces are provided as the spacing members which with the aid of cruciform slits can be plugged onto selected points of intersection of the longitudinal and transverse wires of the wire lattice mats and brace themselves by their ends against the shuttering walls.

According to a further characteristic of the invention elongated spacing members are provided which during casting of the concrete shells can be pulled out from the spaces between structural elements and the shuttering walls.

BRIEF DESCRIPTION OF THE DRAWINGS

Other characteristics and advantages of the invention are explained in more detail below on the basis of exemplified embodiments with reference to the drawings. These show.

DETAILED DESCRIPTION OF THE DRAWINGS

Figure 1A:
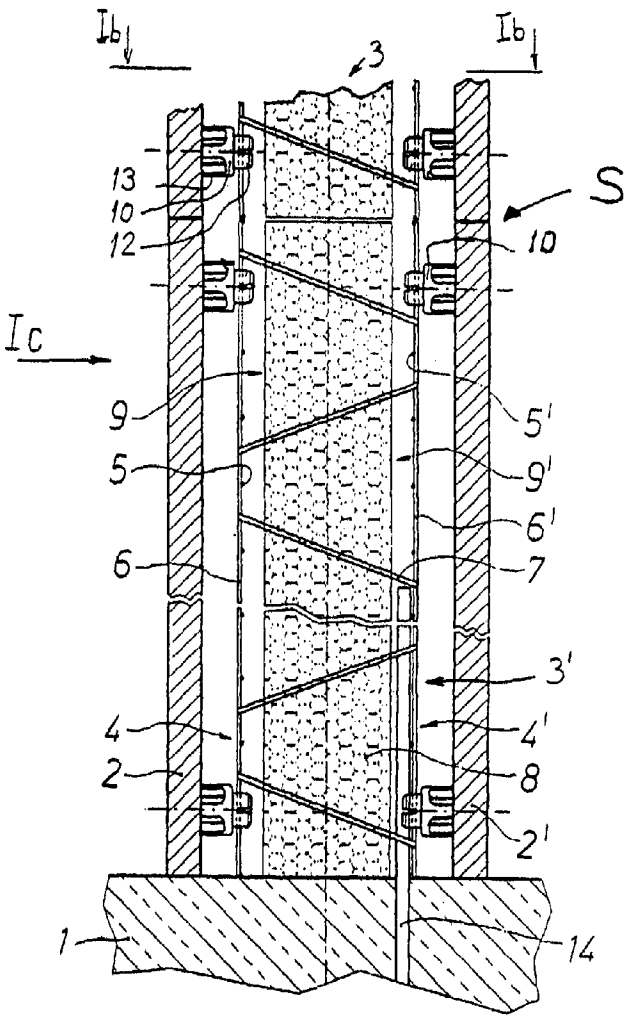
in FIGS. 1*a*, 1*b* and 1*c* an arrangement according to the invention with distance pieces for carrying out the method in cross section, in plan view and in front view.
Figure 1B:
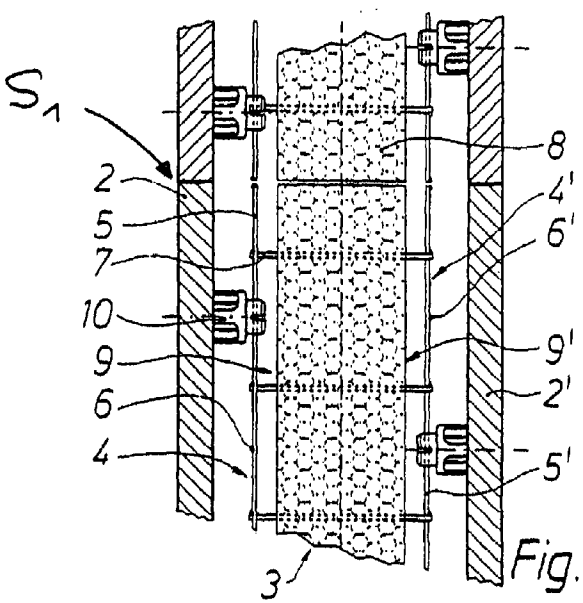

The arrangement illustrated in FIGS. 1*a* and 1*b* consists of a base plate 1, two shuttering walls 2 or 2' and a plurality of central structural elements 3. Each structural element 3 is built up by way of example in accordance with WO 94/28264 and consists substantially of an outer and an inner wire lattice mat 4 or 4' which are arranged parallel to one another at a predetermined distance. Each wire lattice mat 4 or 4' is composed of a plurality of longitudinal wires 5 or 5' and of a plurality of transverse wires 6 or 6' which cross one another and are welded to one another at the points of intersection. The mutual spacing of the longitudinal wires 5, 5' and the transverse wires 6, 6' relative to one another and the diameter of the lattice mat wires 5, 5', 6, 6' is chosen in accordance with the static requirements imposed on the prefabricated wall to be produced. The spacings are preferably chosen to be of equal size and lie by way of example in the range of 50 to 100 mm. The diameters of the longitudinal and transverse wires 5, 5' or 6, 6' lie by way of example in the range of 2 to 5 mm.

The surface of the lattice mat wires 5, 5', 6, 6' may within the scope of the invention be smooth or ribbed. The two wire lattice mats 4, 4' are connected to one another by a plurality of bridging wires 7 to form a dimensionally stable latticework. The bridging wires 7 are each welded at their ends to the wires 5, 5', 6, 6' of the two wire lattice mats 4, 4'. The bridging wires 7 are arranged to slope alternately in opposite directions, ie like trelliswork, by which means the latticework is reinforced against shear stresses. The spacings of the bridging wires 7 relative to one another, their diameter and their distribution in the structural element 3 depend on the static requirements imposed on the prefabricated wall to be produced. The diameter of the bridging wires 7 lies by way of example in the range of 2 to 6 mm and in the case of structural elements having thin longitudinal and transverse wires is preferably chosen on grounds of the greater rigidity of the structural element 3 to be greater than the diameter of the longitudinal and transverse wires 5, 5' or 6, 6' of the wire lattice mat 4, 4'. The bridging wires 7 can be provided within the scope of the invention with a corrosion protection layer which is composed by way of example of a layer of zinc and/or a layer of plastic. The use of bridging wires 7 composed of grades of stainless steel is likewise possible within the scope of the invention. The longitudinal and transverse wires 5, 5' or 6, 6' of the wire lattice mats 4, 4' as well as the bridging wires 7 may have any desired cross-section. For example, the cross-sections may be oval, rectangular, polygonal or square.

The three-dimensional latticework formed by the two wire lattice mats 4, 4' and the bridging wires 7 is a three-dimensional reinforcing element which is able to absorb corresponding shear and compressive forces. For this reason both the longitudinal and transverse wires 5, 5' or 6, 6' are welded to one another as is customary in reinforcing mats and the bridging wires 7 are welded to the lattice mat wires 5, 5', 6, 6' with adherence to a minimum strength for the welded joints. In order to be able to fulfil the function of a three-dimensional reinforcing element the lattice mat wires 5, 5', 6, 6' and the bridging wires 7 must additionally be composed of suitable materials and possess appropriate levels of mechanical strength.

Arranged in the space between the wire lattice mats 4, 4' at a specified distance from the wire lattice mats 4, 4' is an insulating member 8 whose cover surfaces 9 or 9' run parallel to the wire lattice mats 4, 4'. The insulating member 8 serves the purpose of thermal insulation and sound insulation and consists by way of example of foam plastics, such as polystyrene or polyurethane foam, of foamed materials based on natural and synthetic rubber, lightweight concrete, such as autoclaved or gas concrete, of porous plastics, of porous materials based on natural and synthetic rubber, or of mineral and glass wool. Within the scope of the invention the insulating member 8 may also be composed of biological plastics, for example algal foam which is produced from foamed algae or algal cellulose.

The position of the insulating member 8 in the structural element 3 is determined by the bridging wires 7 running at a slant which pass through the insulating member 8. The thickness of the insulating member 8 is freely selectable and lies by way of example in the range of 20 to 200 mm. The spacings of the insulating member 8 relative to the wire lattice mats 4, 4' are likewise freely selectable and are selected in accordance with the desired wall thickness of the prefabricated wall. Within the scope of the invention the insulating member 8 may also be arranged asymmetrically with respect to the two wire lattice mats 4, 4'. Within the scope of the invention one or both wire lattice mats 4, 4' may project laterally over the insulating member 8 on one or more sides.

Figures 2A, 2B, 2C:
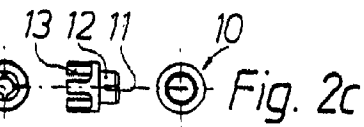
in FIGS. 2*a*, 2*b* and 2*c* a distance piece viewed from below, in side elevation and in plan view.

Distance pieces 10 are pushed into some points of the intersection of the longitudinal and transverse wires 5, 6, or 5', 6' of the wire lattice mats 4, 4'. As FIGS. 2*a*, 2*b* and 2*c* show, the distance pieces 10 have a head 12 provided with two slits intersecting at right angles and a plurality of feet 13 at the opposite end. The distance pieces 10 are made of rustproof material, preferably of plastic. The width of the slit 11 is smaller than the diameter of the lattice mat wires 5, 5', 6, 6' to ensure clamping of the distance pieces 10 at the points of intersection of the lattice mat wires 5, 5', 6, 6'. The depth of the slits 11 and the length of the feet 13 are matched to the desired spacing of the shuttering walls 2, 2' from the wire lattice mats 4, 4'. The spacings lie by way of example in the range of 10–30 mm, wherein within the scope of the invention the shuttering walls may be arranged symmetrically and, as illustrated by dotted lines in FIG. 5*a*, asymmetrically with respect to the structural element 3. The feet 13 are tapered towards the end.

Figure 1C:
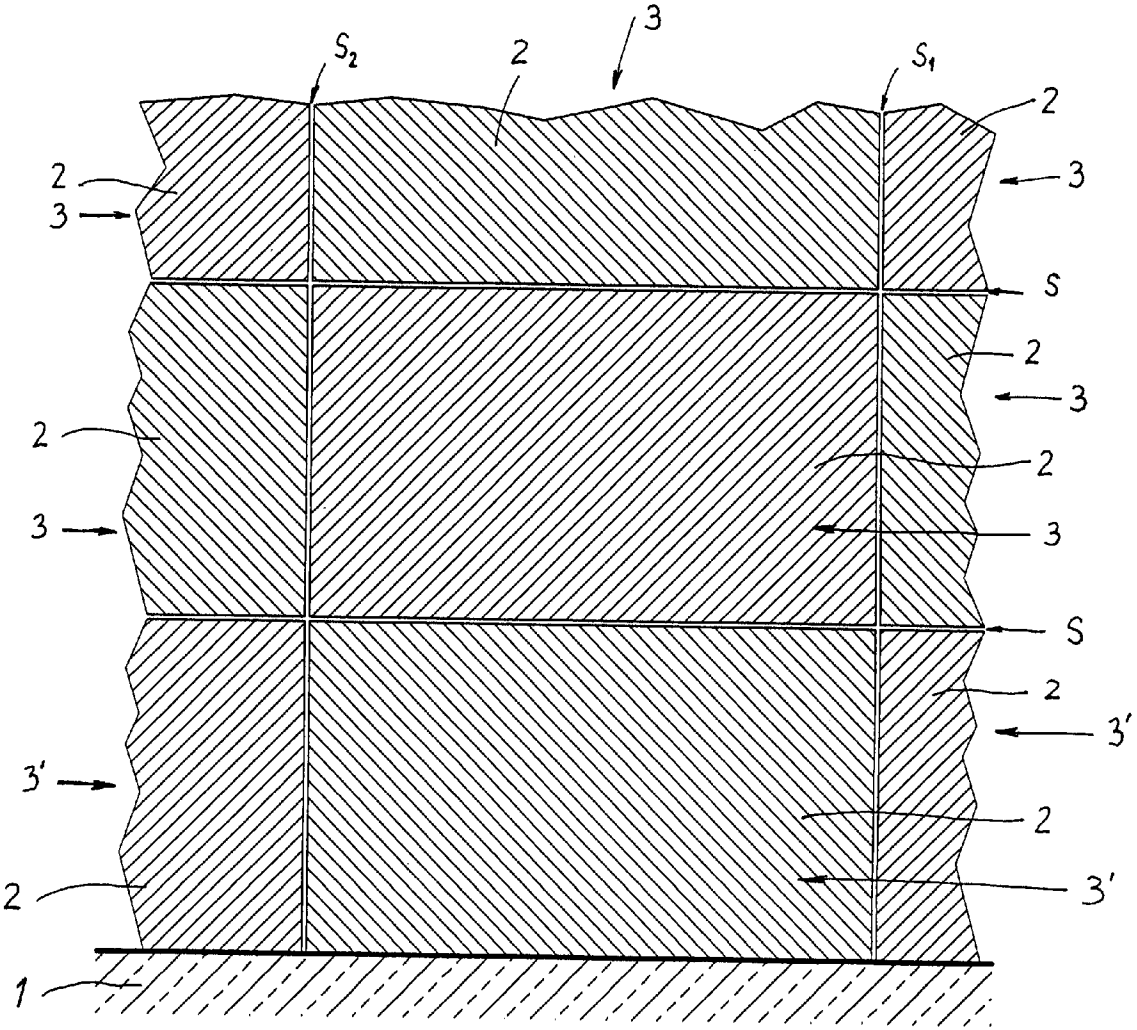

As illustrated in FIGS. 1*b* and 1*c* a plurality of structural elements 3 and a plurality of shuttering walls 2, 2' adjoin one another in the horizontal direction at abutments $S_1$ and $S_2$. For construction of a complete vertical prefabricated wall a plurality of structural elements 3 and a plurality of shuttering walls 2, 2' adjoin one another also in the vertical direction at abutments S shown in FIGS. 1*a* and 1*c*.

Figure 3A:
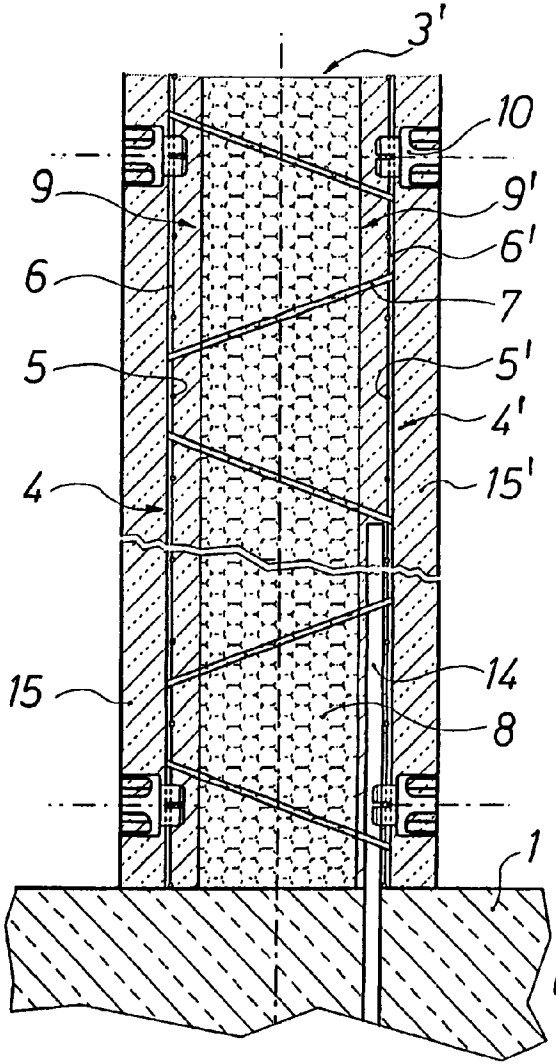
in FIGS. 3*a* and 3*b* a finished cast vertical prefabricated wall produced according to the arrangement in FIGS. 1*a* and 1*b* in section and in plan view.
Figure 3B:
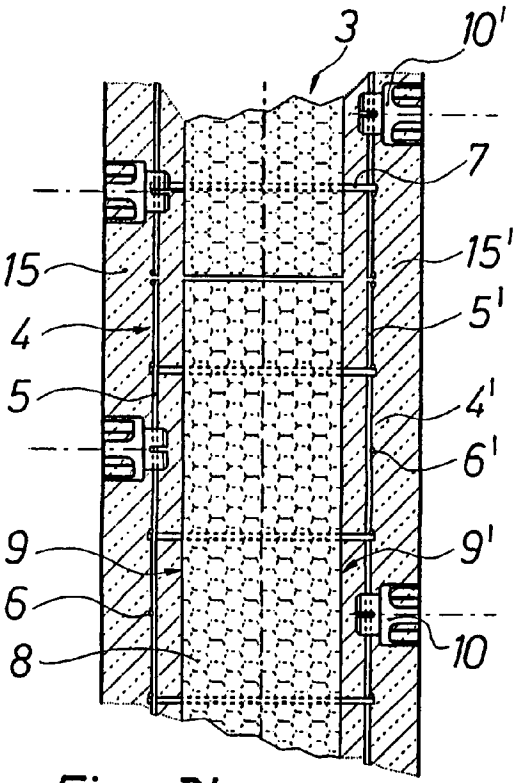

The vertical prefabricated wall is constructed as follows. On the base plate 1 first of all the lower structural element 3' provided with the corresponding distance pieces 10 and all neighbouring structural elements 3' likewise provided with distance pieces 10 are each set up standing vertically on their narrow sides. In doing so it is possible within the scope of the invention to arrange the structural elements 3' in alignment in a straight line or along a curved line or also at any desired angle relative to one another, wherein any desired combinations of these arrangements within a prefabricated wall are possible within the scope of the invention. The position of the lower structural elements 3' on the base plate 1 is fixed by a plurality of rod-shaped reinforcing irons 14 which project by their free ends into the spaces between the insulating member 8 and the wire lattice mats 4, 4' and are anchored, for example cast in place or screwed in, by their other ends in the base plate 1. Subsequently, in further working steps more structural elements 3 are arranged in the vertical direction and the outer and the inner shuttering walls 2 or 2' are built up. Depending on the height of the prefabricated wall the shuttering walls 2, 2' consist of a plurality of sections which are connected, preferably bolted, to one another. All shuttering walls 2, 2' brace themselves against the feet 13 of the distance pieces 10. Concrete is poured into the spaces between the insulating members 8 of the structural elements 3, 3' and the shuttering walls, 2, 2'. After the concrete has hardened, the shuttering walls 2, 2' are removed and the finished cast wall with an outer concrete shell 15 and an inner concrete shell 15' illustrated in section and in plan view in FIGS. 3*a* and 3*b* respectively is produced. Since the feet 13 of the distance pieces 10 terminate in a point at the bottom and, moreover, the distance pieces 10 are made of rustproof material, the distance pieces 10 can remain in the concrete shells 15, 15' without impairing the visual appearance of the visible exteriors of the concrete shells 15, 15'.

Figure 4:
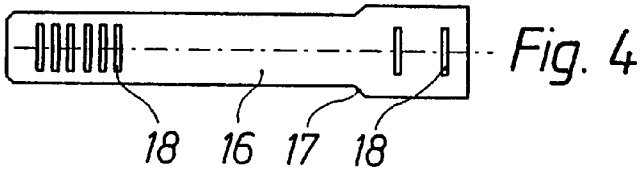
in FIG. 4 a metal spacing plate.

In FIG. 4 another thin spacing member 16 of strip-like construction is illustrated. The metal spacing plate 16 consists of a sheet metal strip which is composed of rustproof material, for example stainless steel or plastic. The metal spacing plate 16 possesses an elbow 17 on both sides and a plurality of slits 18 running crosswise relative to the longitudinal extension of the metal spacing plate 16 to accommodate fixing wedges 19. The width of the metal spacing plate 16 and the dimensions of the elbows 17 are substantially determined by the dimensions of the wire lattice mats 4, 4' as set out below with reference to FIGS. 5*a*, 5*b* and 6*a* and 6*b*. The length of the metal spacing plate 16 and the number and position of the slits 18 in the metal spacing plate 16 are determined by the overall thickness of the prefabricated wall to be produced and the required thicknesses of the concrete shells 15, 15' of the prefabricated wall, ie the distances of the shuttering walls 2, 2' or 2" from the surfaces 9, 9' of the insulating member 8 as set out below with reference to FIGS. 5*a*, 5*b* and 6*a* and 6*b*.

Figure 5A:
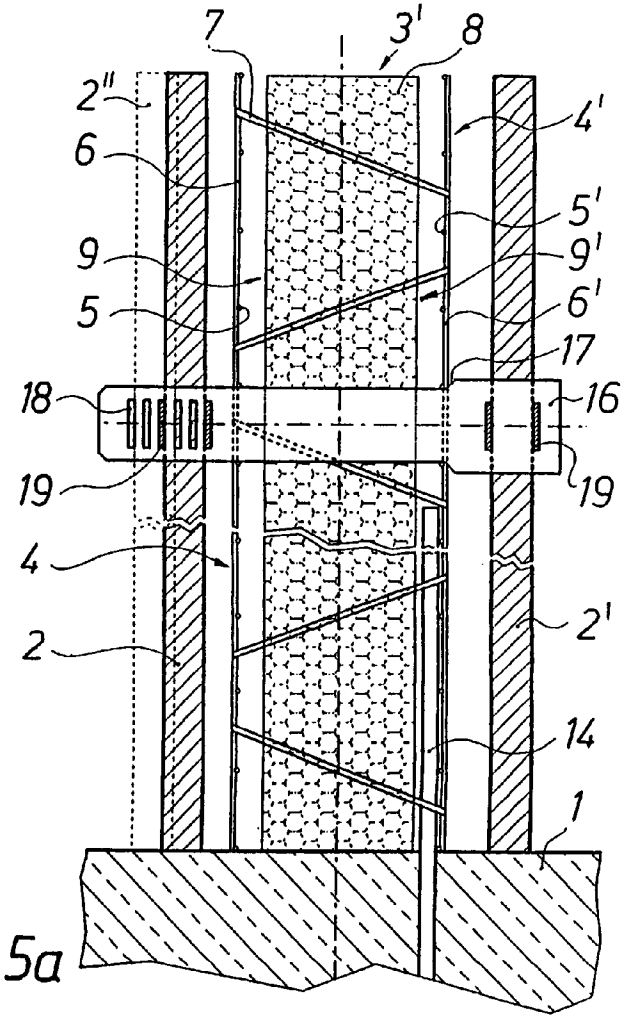
in FIGS. 5*a* and 5*b* another arrangement according to the invention making use of the metal spacing plate shown in FIG. 4.
Figure 5B:
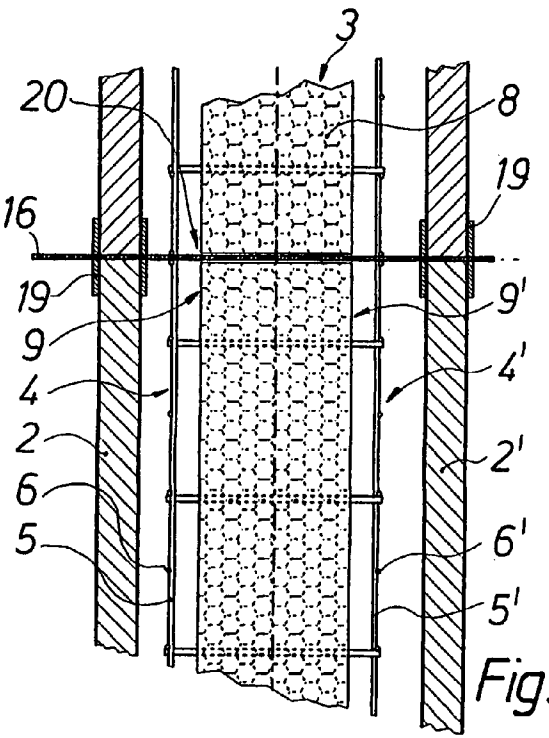
Figure 6A:
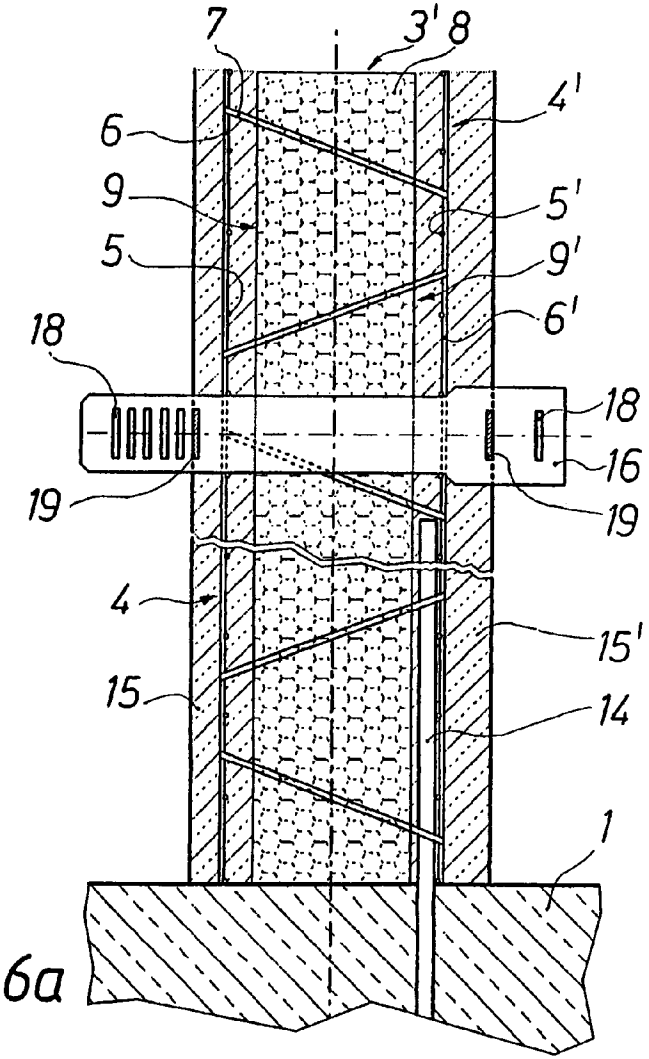
in FIGS. 6*a* and 6*b* a finished cast vertical prefabricated wall produced according to the arrangement in FIGS. 5*a* and 5*b* in section and in plan view.
Figure 6B:
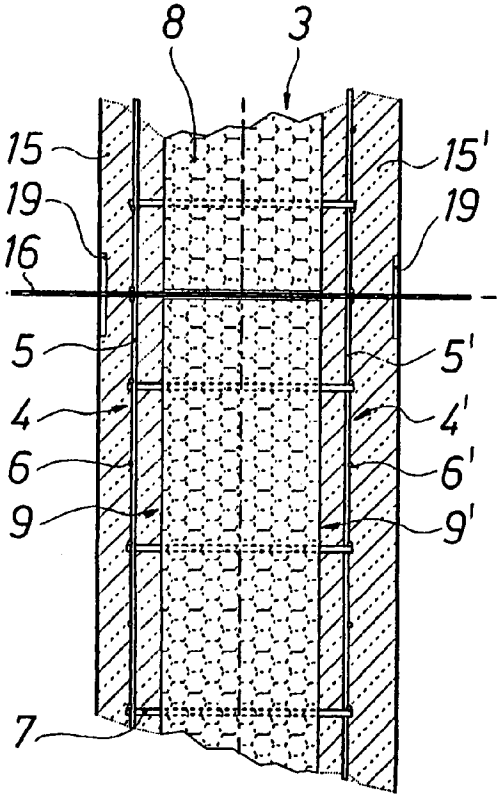

The construction of the prefabricated wall corresponds substantially to the procedure already described, wherein the distance pieces 10 are omitted. Serving as spacing elements are the metal spacing plates 16 which, as illustrated in FIGS. 5*a* and 5*b*, are fitted in the following manner.

In the course of building up the shuttering walls 2, 2' or 2", which is done by analogy with the procedure already described, the metal spacing plates 16 are inserted between the sectional walls of the shuttering walls, whereby the metal spacing plates 16 are punched through the insulating members 8 of the structural elements 3, 3'. The metal spacing plates 16 must possess sufficient rigidity to prevent bending of the metal spacing plates 16 when they are pushed through the insulating member 8. The metal spacing plates 16 are pushed in so far until their elbows 17 rest against the longitudinal wires 5' of the inner wire lattice mat 4'. The fixing wedges 19 are then hammered into the corresponding slits 18 and in that way the shuttering walls 2, 2' or 2" are fixed in position relative to the structural elements 3, 3'.

Concrete is poured into the spaces between the insulating members 8 of the structural elements 3, 3' and the shuttering walls 2, 2' or 2". After the concrete has hardened the shuttering walls 2, 2' or 2" are removed and the finished cast wall with the outer concrete shell 15 and the inner concrete shell 15' illustrated in FIGS. 6*a* and 6*b* in section and in plan view respectively is produced. The wedges located outside the concrete shells 15, 15' are removed and the parts of the metal spacing plates 16 projecting out of the concrete shells 15, 15' are either cut off or bent over.

Figure 7A:
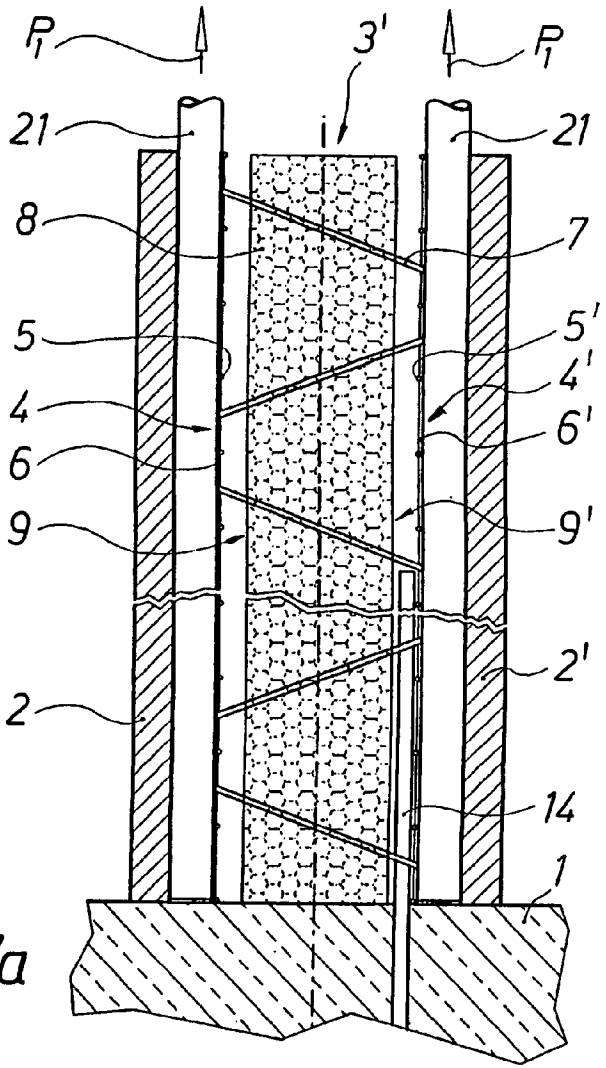
in FIGS. 7*a* and 7*b* another arrangement according to the invention using spacing tubes and in FIGS. 8*a* and 8*b* a finished cast vertical prefabricated wall produced according to the arrangement in FIGS. 7*a* and 7*b* in section and in plan view.
Figure 7B:
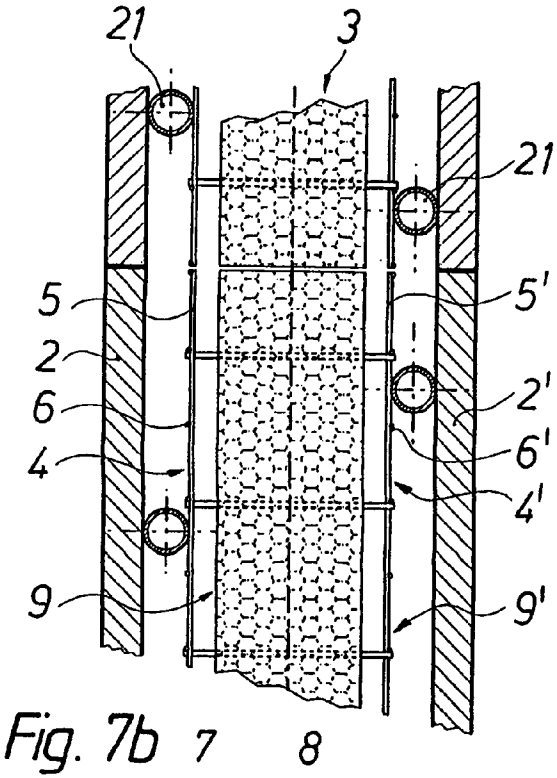

In FIGS. 7*a* and 7*b* another exemplified embodiment for the construction of the shuttering walls 2, 2' is illustrated. The construction of the prefabricated wall corresponds substantially to the procedure already depicted in FIGS. 1*a* and 1*b*, wherein the distance pieces 10 are replaced by spacing tubes 21.

Figure 8A:
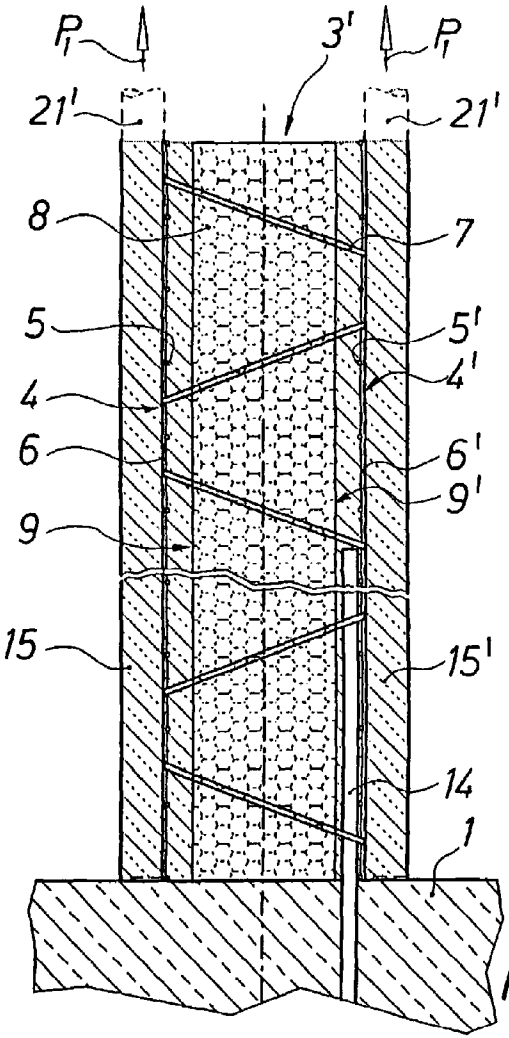
Figure 8B:
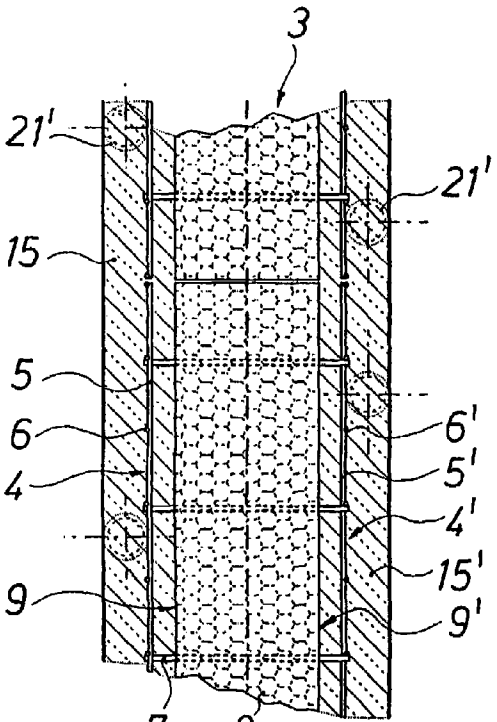

Concrete is poured into the spaces between the insulating members 8 of the structural elements 3, 3' and the shuttering walls 2, 2'. During pouring and hardening of the concrete the spacing tubes 21 are withdrawn stepwise from the still soft concrete just so far that the structure of the shuttering walls remains guaranteed. Prior to the final hardening of the concrete the spacing tubes 21 are withdrawn completely. After complete hardening of the concrete the shuttering walls 2, 2' are removed and the finished cast wall with the outer concrete shell 15 and the inner concrete shell 15' illustrated in FIGS. 8*a* and 8*b* in section and in plan view respectively is produced.

It is evident that the exemplified embodiments described may be modified in various ways within the scope of the general inventive idea; it is possible in particular to construct the clamping parts of the distance pieces differently. It is likewise possible within the scope of the invention to use other suitable spacing members.

It is further possible within the scope of the invention to use the method and the devices to produce horizontally extending prefabricated ceilings also. In this case the outer structural elements are anchored with the aid of suitable reinforcing elements using the prefabricated vertical walls already erected. Within the scope of the invention these reinforcing elements may consist of anchoring rods and/or reinforcing irons and/or reinforcing mats and/or reinforcing strips. It may be necessary to attach additional shuttering elements in order to prevent lateral run-off of the concrete when casting the concrete shells of the prefabricated horizontal ceilings.

The invention claimed is:

1. A device for producing a prefabricated cast concrete element, comprising:

a plurality of central structural elements, each of the plurality of central structural elements comprising two parallel welded wire lattice mats, straight bridging wires welded at each end to the two wire lattice mats holding the wire lattice mats at a predetermined mutual separation and an insulating member penetrated by the bridging wires arranged with its cover surfaces parallel to the wire lattice mats and at a predetermined distance to the wire lattice mats;

shuttering walls arranged on opposing sides of said plurality of central structural elements, each of said shuttering walls comprising a plurality of sections connectable to one another; and a plurality of spacing members composed of rustproof materials arranged and dimensioned for defining a spacing between each of said plurality of structural elements and said shuttering walls for receiving concrete for forming concrete shells, wherein the wire lattice mats comprise longitudinal and transverse wires and said spacing members comprise spacing elements having cruciform slits arranged and dimensioned for receiving selected points of intersection of said longitudinal and transverse wires of said wire lattice mats and having ends opposing said cruciform slits braced against said shuttering walls.

2. The device of claim 1, wherein each of said spacing elements is composed of plastic and has feet tapering towards the end.

3. A device for producing a prefabricated cast concrete element, comprising:

a plurality of central structural elements, each of the plurality of central structural elements comprising two parallel welded wire lattice mats, straight bridging wires welded at each end to the two wire lattice mats holding the wire lattice mats at a predetermined mutual separation and an insulating member penetrated by the bridging wires arranged with its cover surfaces parallel to the wire lattice mats and at a predetermined distance to the wire lattice mats;

shuttering walls arranged on opposing sides of said plurality of central structural elements, each of said shuttering walls comprising a plurality of sections connectable to one another;

a plurality of spacing members composed of rustproof materials arranged and dimensioned for defining a spacing between each of said plurality of structural elements and said shuttering walls for receiving concrete for forming concrete shells; and a base plate, wherein lower ones of said plurality of central structural elements are fixed firmly in position with reinforcing irons anchored in said base plate.

* * * * *